United States Patent [19]

Volinskie et al.

[11] 3,990,766

[45] Nov. 9, 1976

[54] LEAD ASSEMBLY

[75] Inventors: Robert Volinskie, Hershey; William Ludlow Schumacher, Camp Hill, both of Pa.

[73] Assignee: AMP Incorporated, Harrisburg, Pa.

[22] Filed: Mar. 7, 1975

[21] Appl. No.: 556,518

Related U.S. Application Data

[63] Continuation of Ser. No. 464,376, April 26, 1974, abandoned.

[52] U.S. Cl. ..... 339/177 E; 339/191 S; 339/258 P; 339/276 T

[51] Int. Cl.[2] ..... H01R 11/08

[58] Field of Search ..... 339/177 R, 177 E, 191 R, 339/191 M, 191 S, 192 R, 192 RL, 258 R, 258 C, 258 F, 258 P, 256 R, 256 L, 259 R, 259 F, 262 R, 262 F, 262 P, 276 T

[56] References Cited

UNITED STATES PATENTS

| | | | |
|---|---|---|---|
| 3,363,224 | 1/1968 | Gluntz | 339/258 P |
| 3,601,780 | 8/1971 | De Lyon | 339/192 RL |
| 3,663,931 | 3/1972 | Brown | 339/256 R X |
| 3,711,819 | 1/1973 | Matthews | 339/258 R X |
| 3,764,960 | 10/1973 | Heimbrock | 339/192 RL X |
| 3,786,395 | 1/1974 | De Luca | 339/192 R X |
| 3,808,578 | 4/1974 | Hansen | 339/258 P X |
| 3,874,764 | 4/1975 | Volinskie | 339/191 R X |
| 3,907,392 | 9/1975 | Haag et al. | 339/258 P X |

*Primary Examiner*—Joseph H. McGlynn
*Assistant Examiner*—Howard N. Goldberg
*Attorney, Agent, or Firm*—Allan B. Osborne

[57] ABSTRACT

This invention relates to an assembly for use on a pair of adjacent posts where a signal circuit is connected to one post and a ground circuit is connected to the other post. More particularly, the invention includes a molded housing of insulating material having passageways therethrough and recesses for terminating devices therein, and terminating devices having wire terminating means and post receiving spring members thereon.

1 Claim, 7 Drawing Figures

Fig. 4
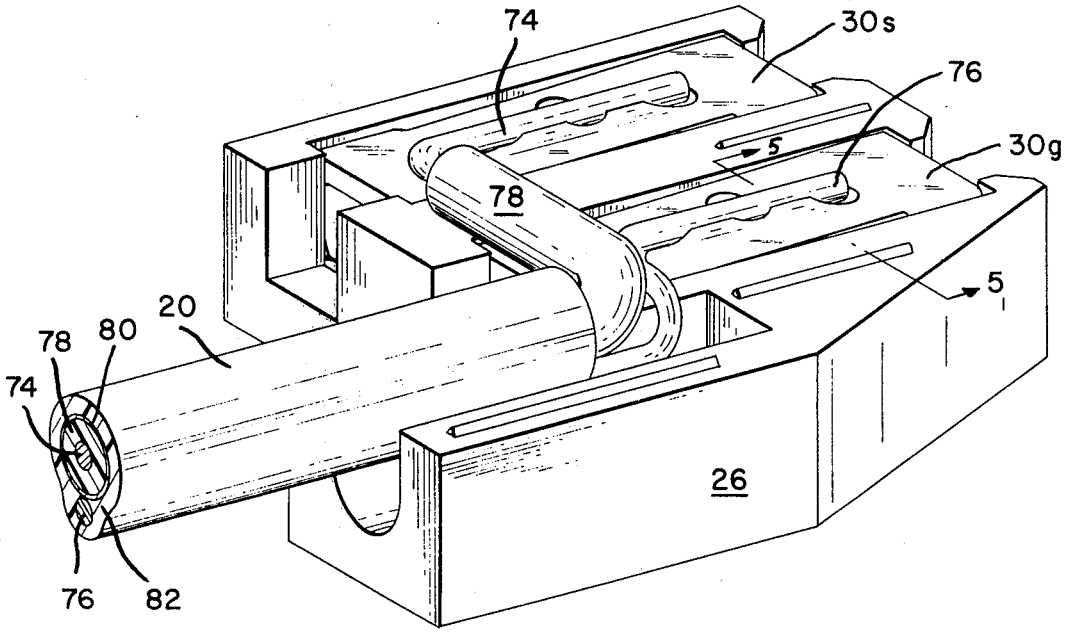
Fig. 5
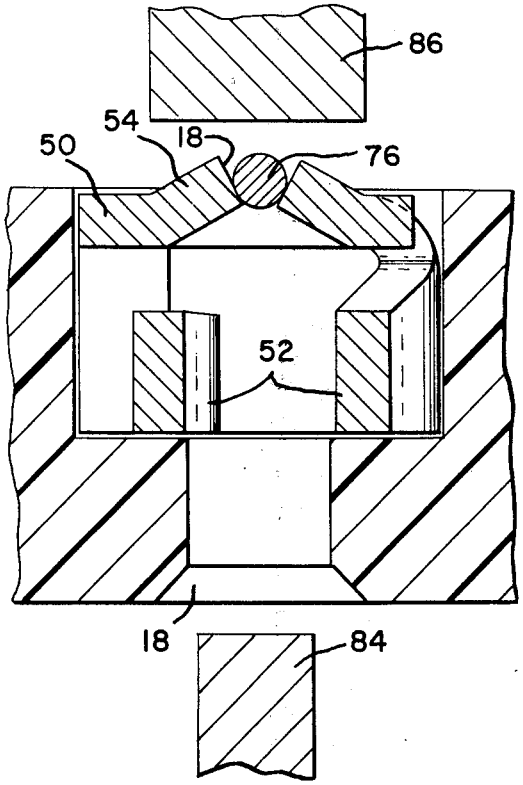
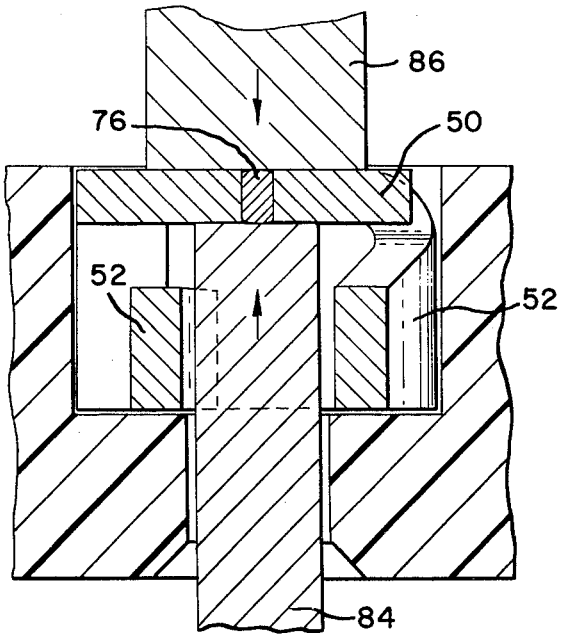
Fig. 6

LEAD ASSEMBLY

This is a continuation of application Ser. No. 464,376, filed Apr. 26, 1974, abandoned.

BACKGROUND OF THE INVENTION

Many applications use square posts projecting outwardly from the back of panels such as used in computer machines and in telephone exchanges. Square posts are also used in conjunction with printed circuit boards. A variety of ways of connecting wire to these square posts have been used in the past. For example, where the posts are spaced wide enough apart, wire wrapping techniques provides an acceptable termination.

Terminating coaxial cable; i.e., cable having a center or signal-carrying wire, a shielding jacket and a ground wire for the shielding jacket, in miniature applications is quite a different problem. The difficulty lies in the fact that two wires must be terminated in an extremely small space. An example of such dimensions is square posts 0.025 inches on a side and with a large number of them being positioned on a back panel in 0.100 inch centers.

Accordingly, it is an object of this invention to provide a device for terminating coaxial wire and a means for removably connecting such onto square posts.

BRIEF DESCRIPTION OF THE DRAWINGS

FIG. 4 illustrates the positioning of the terminating devices and wires within the lead assembly of FIG. 1;

FIGS. 5 and 6 taken along lines 5—5 of FIG. 4 illustrate the method of terminating wires to the terminating device.

DESCRIPTION OF THE PREFERRED EMBODIMENT

Figure 1:
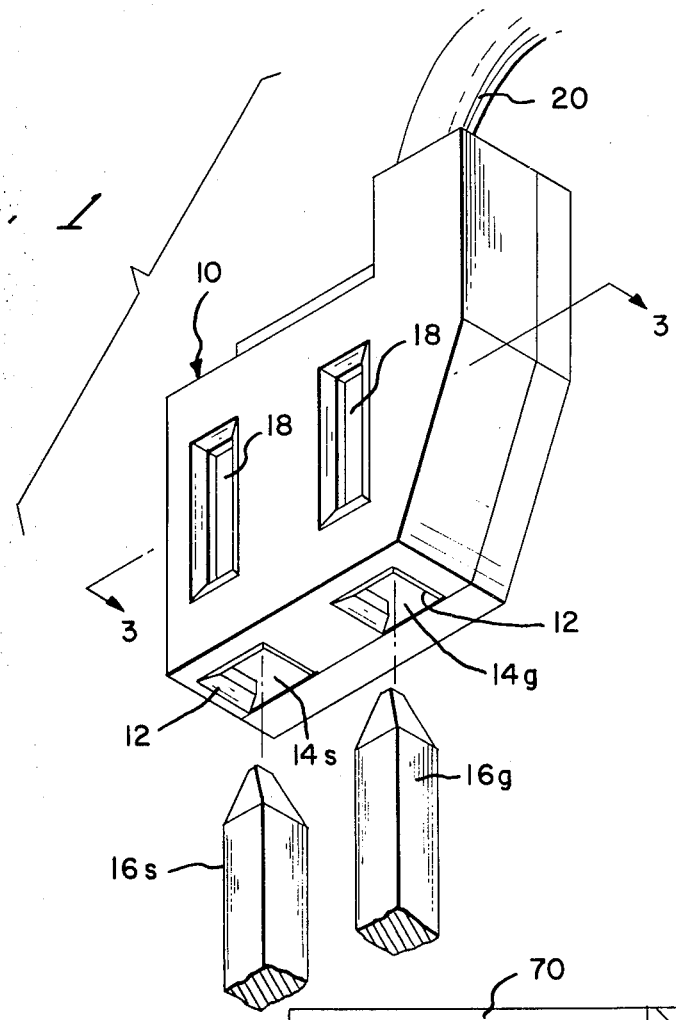
FIG. 1 illustrates a lead assembly, constructed in accordance with the present invention, about to be mounted on a pair of posts.

The lead assembly 10 in FIG. 1 shows the lower openings 12 to passageways 14*g* and 14*s*, the *g* standing for ground and *s* for signal. As is conventional, these openings are beveled to facilitate sliding the assembly onto square posts 16*g* and 16*s*.

The two elongated ports 18 which are located on one side of the assembly are for purposes of admitting terminating dies into cavities in the housing (FIGS. 5 and 6).

A coaxial cable 20, seen entering the lead assembly from above, is a conventional type having a center signal wire and a parallel ground wire with a dielectric and shielding between.

Figure 2:
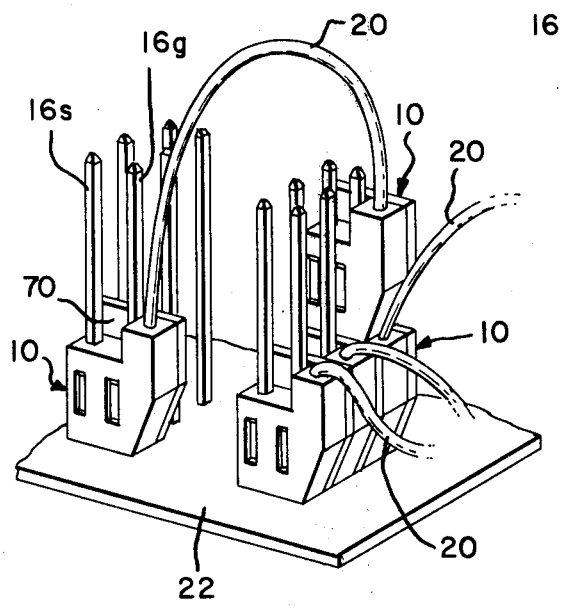
FIG. 2 illustrates several lead assemblies of the type shown in FIG. 1 positioned on square posts on a back panel.

FIG. 2 illustrates the uses of lead assemblies 10. A back panel 22 containing a number of pairs of posts 16*g*, 16*s* requires the receipt of signals from without as well as interconnections within. Further, any one pair of posts may require more than one type of connection. FIG. 2 demonstrates the fulfillment of these requirements by lead assemblies 10. Note how the beveled portion of the lead assembly enables the stacking of such without interference with coaxial cables 20.

Figure 3:
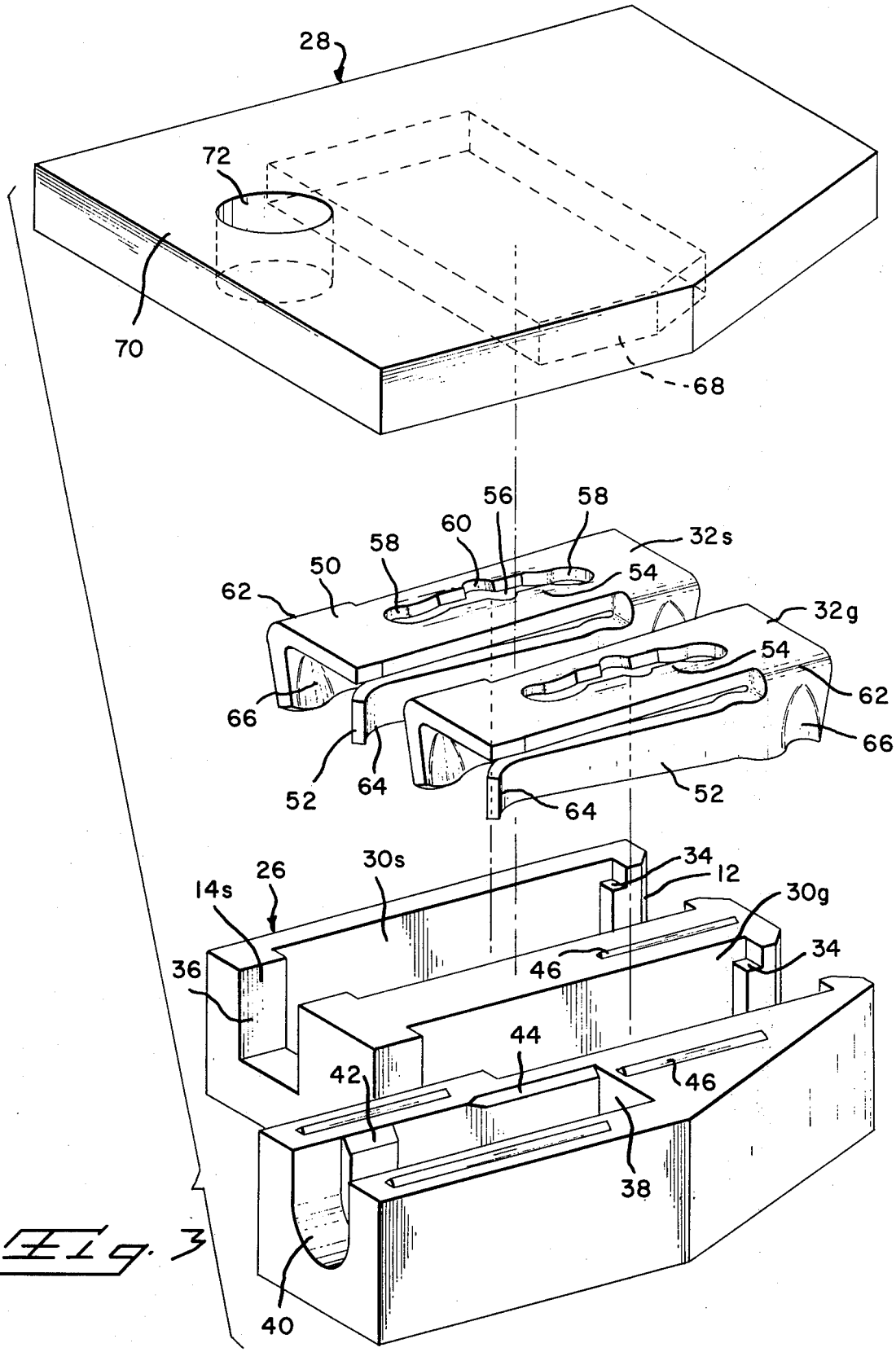
FIG. 3 is an exploded view of the lead assembly of FIG. 1.

FIG. 3 shows in exploded fashion a lead assembly 10. The housing of the assembly consists of a cavity-carrying member 26 and a cover 28. Preferably the housing is molded from glass-filled nylon although other insulating materials can be used.

The cavity-carrying member 26 contains two parallel cavities 30*g* and 30*s* which receive terminating devices 32*g* and 32*s* pictured directly above the respective cavities. Each cavity is rectangular in shape and contains, in two diagonally opposed corners, a plate support shoulder 34.

Passageways 14*g* and 14*s* bisect the respective cavities. The upper openings 36 to the passageways are defined by straight walls as opposed to the beveled lower openings 12.

One side of the cavity-carrying member has been extended to provide a coaxial cable cavity 38. The opening 40 is semi-curved to complement the round cable. Inside the cavity a wide, flat rib 42 projects inwardly from the walls defining the cable cavity. This rib provides insulation retention and support. A portion of the edge of the cavity is beveled so indicated by reference numeral 44 to eliminate a sharp edge which otherwise may score cable 20.

A number of elongated triangular strips 46 are seen positioned on the surface of member 26. These strips provide fusing material for the ultra-sonic bonding of member 26 to cover 28.

Terminating devices 32*g* and 32*s* are identical one to the other. Each consists of a plate 50 and a pair of integral spring arms 52 running parallel to the plate to form a three-sided box. The surface of the plate is bulged or deformed outwardly into an elongated dish-like shape as shown generally by reference numeral 54. A slot 56 bisecting the deformed area contains at either end an enlarged circular cutout 58 and in the middle another cutout 60.

The pair of spring arms 52 on each device 32 are attached only at one end to plate 50 at diagonal ends and are perpendicular to the plane of the plate. The singular point of attachment is shown by reference numeral 62. Each arm 52 gradually bends inwardly from the attached point 62 so that the free end 64 of each arm is positioned well beneath the plate. Also the free end is curved to facilitate placing the lead assembly onto the posts and further to enhance the spring characteristics of the arm.

The arm at the point of attachment 62 is furrowed as shown at 66. The space between the free end of one arm and the furrowed area 66 on the opposing arm at each end is predetermined to biasingly receive a post 16. The construction and positioning of spring arms 52 may be seen in FIG. 7.

Terminating devices 32 are received into cavities 30 with the diagonal ends of plate 50 overlying free ends 64 resting on shoulders 34. As the devices and cavities are end to end symmetrical, there is no need for keying or other orientating structure.

Figure 7:
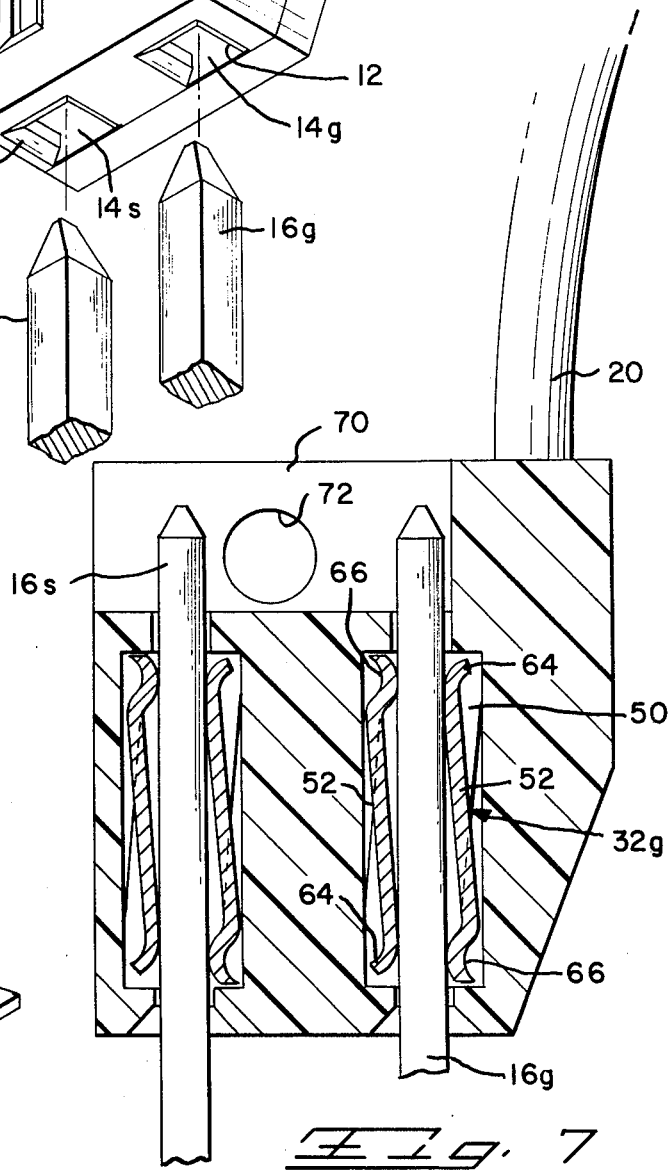
FIG. 7 is a cross-sectional view taken along lines 3—3 of FIG. 1.

Cover 28 contains an inwardly opening recess 68 to accommodate the coaxial cable wires which lie over parts of the surface of member 26. A portion of cover 28 extends free of cavity-carrying member 26 as can be seen in FIGS. 2 and 7. This portion, generally designated by reference numeral 70, provides a location for hole 72 therein. This hole enables one to remove a lead assembly 10 from posts 16 with a hook-type extraction tool (not shown).

FIG. 4 illustrates a stage in assembly. As noted elsewhere but not called out, the coaxial cable 20 contains a center signal wire, hereinafter numbered 74, and a ground wire, hereinafter numbered 76. The dielectric is numbered 78 and the foil shielding 80. The outer insulating jacket is numbered 82. The various insulation and dielectric material is stripped away exposing bare signal wire 74 and ground wire 76. These bared ends are laid in slots 56 in the respective terminating devices, which are disposed in cavities 30.

FIGS. 5 and 6 demonstrate the termination of a wire to the terminating device. An anvil 84 is brought up through port 18 and positioned beneath the bulged-out area 54 on plate 50. Wire 76 is placed along slot 56. A stamping die 86 or other hammer-like tooling is driven down on top of plate 50 thereby flattening the bulged-out area 54 to a horizontal plane. In so doing, the walls of slot 56 are pushed in against the wire, compressing it such as shown in FIG. 6. The residue forces of tension in plate 50 and the forces of compression in the squeezed wire provide an effective electrical and mechanical termination.

Subsequent to the termination of wire 74 and 76 onto devices 30, cover 28 is ultra-sonically or otherwise bonded to member 26 and lead assembly 10 is complete, ready for use as shown in FIGS. 1, 2 and 7.

FIG. 7 provides a clear picture of the relation of spring arms 52 to posts 16. The curved areas on the arm enable the posts to slide through the terminating device without catching. Further, these curved areas provide positive contact points with the posts. As with any conventional spring arm, pre-deformation; i.e., the inward bending of the arms noted above, decreases the space between arms to a width less than that of the posts. Then, as the posts slide through, the arms are forced apart. This places the arms in tension which continually exerts a biasing force on the posts.

It will be noted that redundant contact points are obtained by the free end 64 pressing the post 16 against fixed opposite furrowed area 66 in two places making four contact points by two independent springs. If ends 64 were opposite, only one spring action with two contact points would be possible.

The foregoing detailed description has been given for clearness of understanding only, and no unnecessary limitations should be understood therefrom, as some modifications will be obvious to those skilled in the art.

What is claimed is:

1. A lead assembly containing terminated signal and ground wires and useful for being slidingly received on a pair of upstanding posts, which comprises:

a. a cavity carrying member containing a first and second separate, parallel cavities for receiving termination devices and a third cavity for receiving a cable containing a signal wire and a ground wire;

b. a pair of terminating devices each positioned in the first and second cavities and having a plate with a bulged-out area with a slot bisecting that area and a pair of spring arms each attached at one end to opposite and diagonal ends of the plate with the free ends of each arm extending in opposite directions, parallel and at right angles to the plate, said arms adapted to slidingly receive a post thereinbetween, said slot adapted to receive a wire therein and said bulged-out area adapted to be forcefully deformed to the same plane as the plate whereby the walls of the slot compress the wire inbetween thereby effecting a mechanical grip and electrical connection; and c. a cover for covering the cavity-carrying member after the wires are terminated therein.

* * * * *